US010775119B2

(12) United States Patent
Conle

(10) Patent No.: US 10,775,119 B2
(45) Date of Patent: Sep. 15, 2020

(54) FIREARM

(71) Applicant: Henning Conle, Zurich (CH)

(72) Inventor: Henning Conle, Zurich (CH)

( * ) Notice: Subject to any disclaimer, the term of this patent is extended or adjusted under 35 U.S.C. 154(b) by 0 days.

(21) Appl. No.: 16/420,225

(22) Filed: May 23, 2019

(65) Prior Publication Data

US 2019/0360773 A1 Nov. 28, 2019

(30) Foreign Application Priority Data

May 23, 2018 (AT) ..... 50419/2018

(51) Int. Cl.
*F41A 17/34* (2006.01)

(52) U.S. Cl.
CPC ..... *F41A 17/34* (2013.01)

(58) Field of Classification Search
CPC ..... F41A 17/34; F41A 17/38; F41A 19/30
USPC ..... 42/18, 7
See application file for complete search history.

(56) References Cited

U.S. PATENT DOCUMENTS 4,266,357 A * 5/1981 Greenleaf ..... F41C 3/02 42/1.15
5,299,373 A * 4/1994 Breiner ..... F41A 9/25 42/15
5,784,821 A * 7/1998 Gerard ..... F41A 9/25 42/15
6,571,499 B1 * 6/2003 Dikov ..... F41A 9/25 42/11
8,756,843 B1 * 6/2014 Cantrell ..... F41A 3/10 42/49.01
9,103,609 B2 * 8/2015 Cantrell ..... F41A 3/10
2015/0184961 A1 * 7/2015 Cantrell ..... F41A 15/00 42/7
2016/0313078 A1 * 10/2016 Dove ..... F41A 9/68

FOREIGN PATENT DOCUMENTS

DE 349246 C 2/1922
DE 368718 C 2/1923
DE 401461 C 9/1924
EP 0224018 A1 * 6/1987 ..... F41A 9/17

* cited by examiner

*Primary Examiner* — John Cooper
(74) *Attorney, Agent, or Firm* — Laurence A. Greenberg; Werner H. Stemer; Ralph E. Locher

(57) ABSTRACT

A firearm has a barrel, a trigger, a bolt assembly and a magazine well with a longitudinal direction, in which a magazine is movably accommodated in the longitudinal direction. A manually actuable slide is movable substantially transversely to the longitudinal direction. The slide engages on a driver connected to the magazine and moves the driver with the magazine from a safety position into a feed position.

13 Claims, 3 Drawing Sheets

FIREARM

BACKGROUND OF THE INVENTION

Field of the Invention

The invention relates to a firearm comprising a barrel, a trigger, a bolt assembly and a magazine well having a longitudinal direction, in which a magazine movable in the longitudinal direction is accommodated.

The invention relates, in particular, to a safety for small arms or handguns.

A very wide variety of systems are in use on firearms, especially small arms or handguns, to prevent the accidental firing of a shot. Known safeties act on firing pins, hammers or parts of the bolt assembly or of the trigger assembly, for example. Apart from the fact that most safeties only act when they are manually activated, they can fail mechanically, especially if they break or if the weapon falls to the ground.

BRIEF SUMMARY OF THE INVENTION

It is therefore the underlying object of the invention to provide a firearm of the type stated at the outset which offers enhanced safety against accidental firing of a shot.

This object is achieved by means of a firearm as claimed.

In the invention, a manually actuable slide, which is movable substantially transversely to the longitudinal direction of the magazine well or grip and which engages on a driver connected to the magazine and moves this driver with the magazine from a safety position into a feed position, is arranged on the firearm, preferably on the grip of the firearm, in the region of the trigger.

According to the invention, the magazine is always situated in the lower safety position or position remote from the bolt assembly, except when the slide is pressed by hand and the magazine is thereby moved upward from the safety position into the feed position. This ensures that, in the safety position, there is no cartridge in the region of a driver conventionally situated on the bolt assembly that can be pushed into the chamber of the barrel and fired there.

The invention is employed primarily on weapons with a blow-forward action, on which the bolt assembly is held in the rear position in the ready-to-fire state and there is no cartridge in the chamber. If the slide is not pressed and the bolt assembly accidentally moves forward to the barrel, it is not possible for a cartridge to be fed in from the magazine and therefore for a shot to be fired. However, the safety according to the invention can also be used on weapons of different design, especially fully automatic weapons, on which there is already a cartridge in the barrel in the ready-to-fire state and the bolt assembly is closed because it is then at least possible by means of the invention to prevent a second cartridge being fed into the cartridge magazine and fired after a shot has been fired accidentally.

In one embodiment of the invention, the driver is arranged directly on the magazine. The magazine is therefore moved into the feed position directly by the slide.

In an alternative embodiment of the invention, the magazine well has a section which can be moved in the longitudinal direction and is connected to the magazine, and the driver is arranged on the movable section of the magazine well. In this case, the magazine is therefore moved into the feed position indirectly by the slide via the movable section of the magazine well.

To ensure good guidance of the magazine, it is preferred in the last-mentioned embodiment of the invention if the magazine well has a fixed section and the section which can be moved in the longitudinal direction since the magazine is held reliably by the movable section of the magazine well and guided precisely in the fixed section.

A particularly simple construction and particularly reliable operation of the safety according to the invention are made possible by the fact that the slide and the driver are connected to one another by a guide, which has a region aligned obliquely to the longitudinal direction. This is because the angle at which the guide is aligned relative to the longitudinal direction of the magazine well is an effective means of setting the ratio of force to displacement with which the slide has to be actuated and moved by hand, and of force to displacement with which the magazine is moved. On the other hand, a suitably chosen angle can be used to exploit the effect of self locking, that is to say that the friction in the guide prevents the slide being moved by the action of a high force on the magazine, e.g. due to the weapon falling on the ground, which could cause the uppermost cartridge in the magazine to enter the region of the driver on the bolt assembly. Given these boundary conditions, it is possible to find an optimum angle for each particular case.

As an alternative to a guide with an obliquely aligned region, it is of course also possible to transmit the force from the slide to the magazine directly or indirectly via a lever or the like.

If the slide and the driver are connected to one another by a guide, there is the possibility of a refinement of the present invention in that the guide has an elongate aperture arranged on the slide, in which the driver engages. As an alternative, however, it is also possible, for example, for the driver, which is arranged on the magazine or on the movable section of the magazine well for example, to have an elongate aperture in which a projection arranged on the slide engages.

The elongate aperture can be formed by a groove or a slot in the slide, in the movable section of the magazine well or in the magazine itself, for example, and, correspondingly, the driver can have a projection, bolt or pin which engages in the groove or slot.

As mentioned, suitable choice of the angle of the obliquity of the guide already offers the possibility of preventing unintentional movement of the magazine with a relatively high reliability. However, this can be prevented with even greater reliability if the guide has, at one end, a further region, which is aligned substantially transversely to the longitudinal direction. According to the invention, this further region is arranged at the end of the guide at which the driver engaging in the guide is arranged when the slide is in the safety position. The arrangement of the further region transversely to the longitudinal direction of the magazine well makes it impossible for the magazine to move accidentally into the feed position.

In addition or as an alternative, it is also possible for the guide to have, at the other end, a third region, which is aligned substantially transversely to the longitudinal direction of the magazine well. By means of this additional region, which, according to the invention, is situated at the end of the guide at which the driver engaging in the guide is arranged when the slide is in the feed position, it is possible in this position to prevent a force being exerted on the slide in the direction of the safety position by the magazine.

In order to move the magazine automatically from the feed position into the safety position when the slide is not actuated or pressed, there is the possibility according to the invention that the slide and/or the magazine and/or the movable section of the magazine well can be moved out of a safety position into a feed position against the force of a spring.

As already mentioned, the slide is preferably arranged in the region of a trigger of the firearm. In the region of the trigger there is usually a grip, in which, in a further preferred embodiment of the invention, there is arranged a holder, on which the slide and the movable section of the magazine well are movably mounted. This provides a very compact and user-friendly possibility of being able to actuate both the safety according to the invention, i.e. the slide, and the trigger of the weapon with one hand.

Further features and advantages of the invention will emerge from the following description of a preferred illustrative embodiment of the invention, which does not restrict the scope of protection, with reference to the attached drawings. In the drawings:

DESCRIPTION OF THE INVENTION

Figure 1:
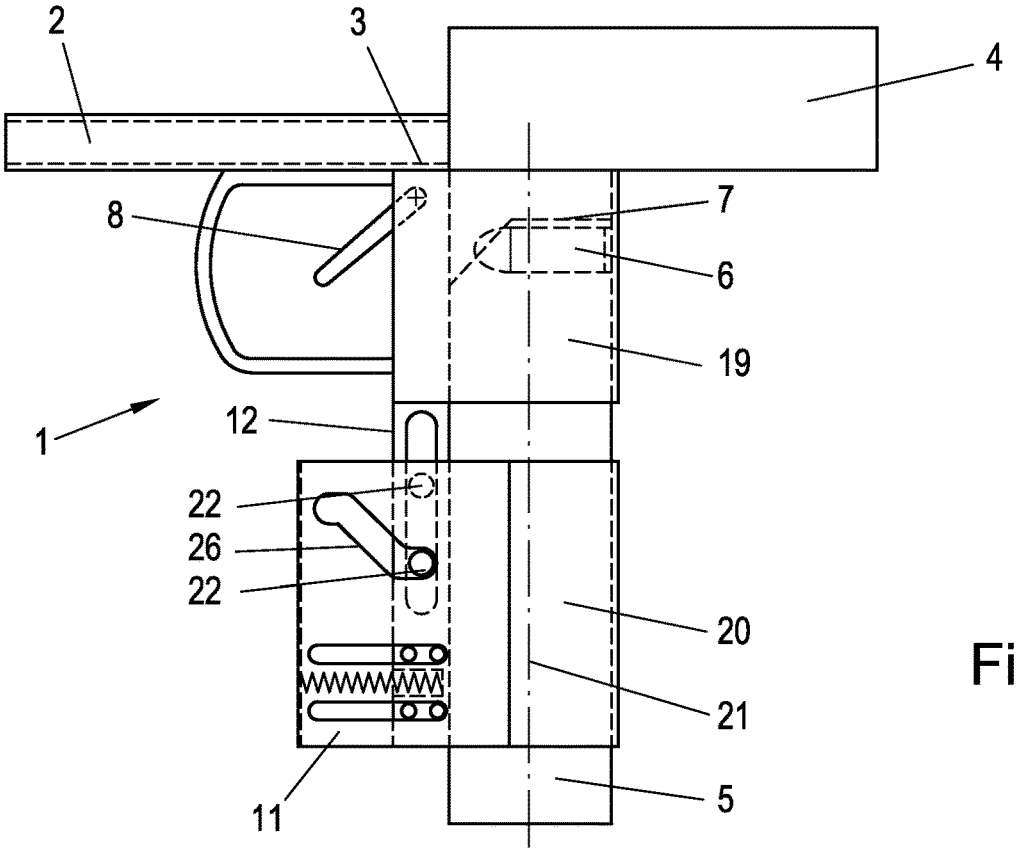
FIG. 1 shows schematically a firearm according to the invention with a magazine in a safety position.
Figure 2:
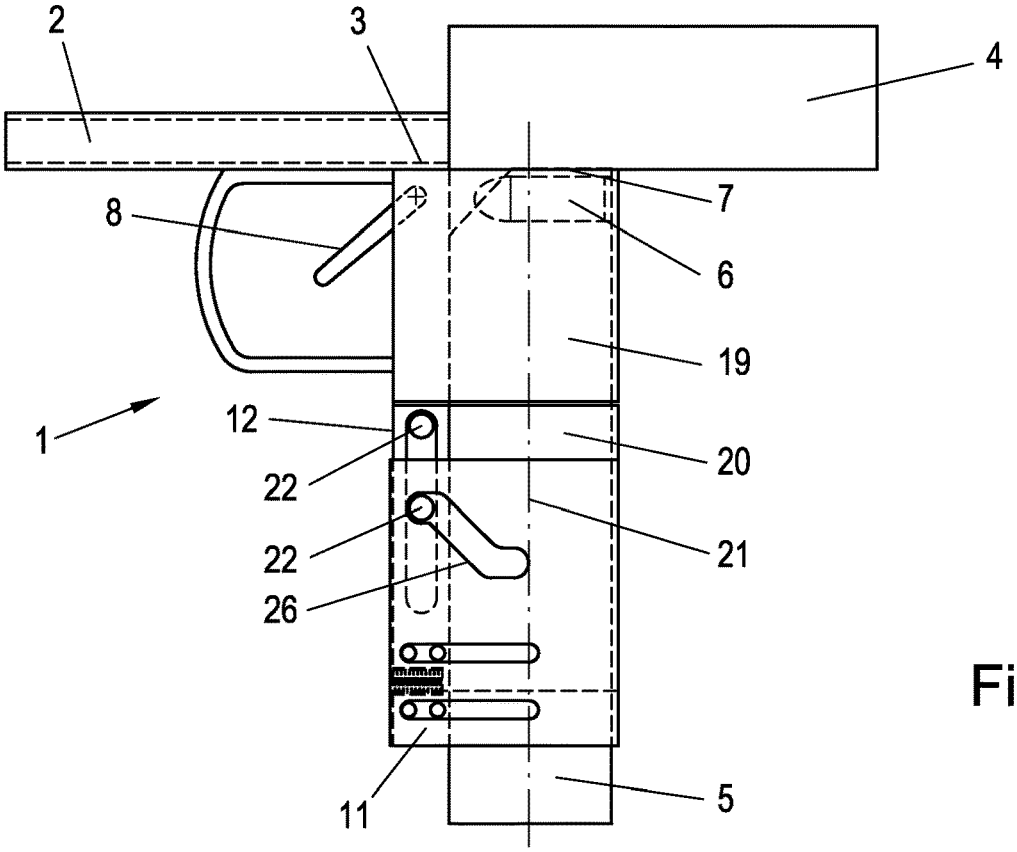
FIG. 2 shows the firearm of FIG. 1 with the magazine in a feed position.

FIGS. 1 and 2 illustrate, in highly schematic form, a firearm 1 according to the invention, wherein components of the firearm 1 which are known per se, such as a barrel 2 having a chamber 3, a trigger 8 of a trigger assembly, a bolt assembly 4 and a magazine 5 with a cartridge 6 are not illustrated or not illustrated in detail because these can be embodied in the manner known per se from the prior art. A safety 10 according to the invention which is illustrated in the drawings can be the only safety of the firearm 1 but can also be present in addition to a safety known per se of the firearm 1.

Figure 3:
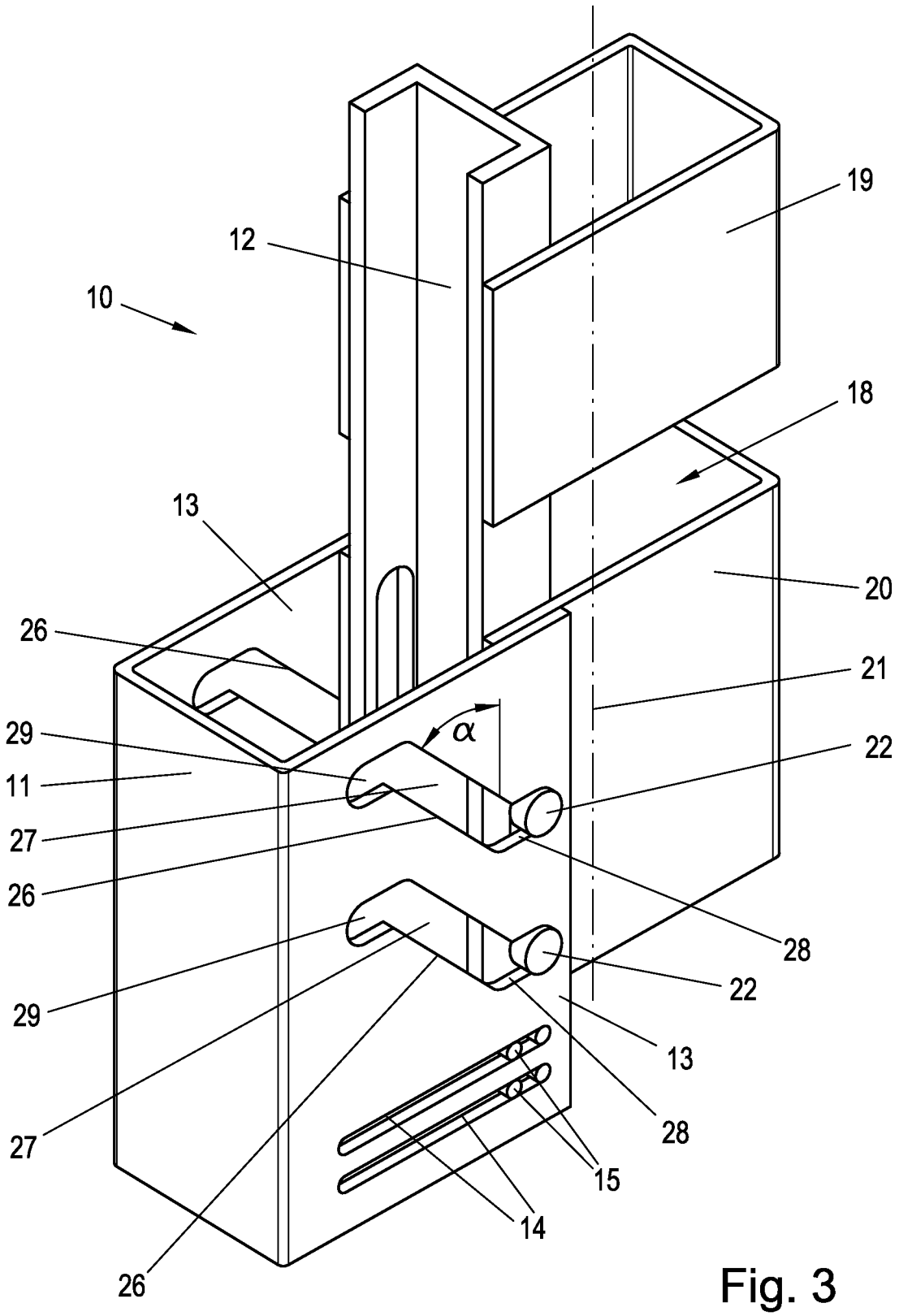
FIG. 3 shows schematically a detail of a safety according to the invention in the assembled state.
Figure 4:
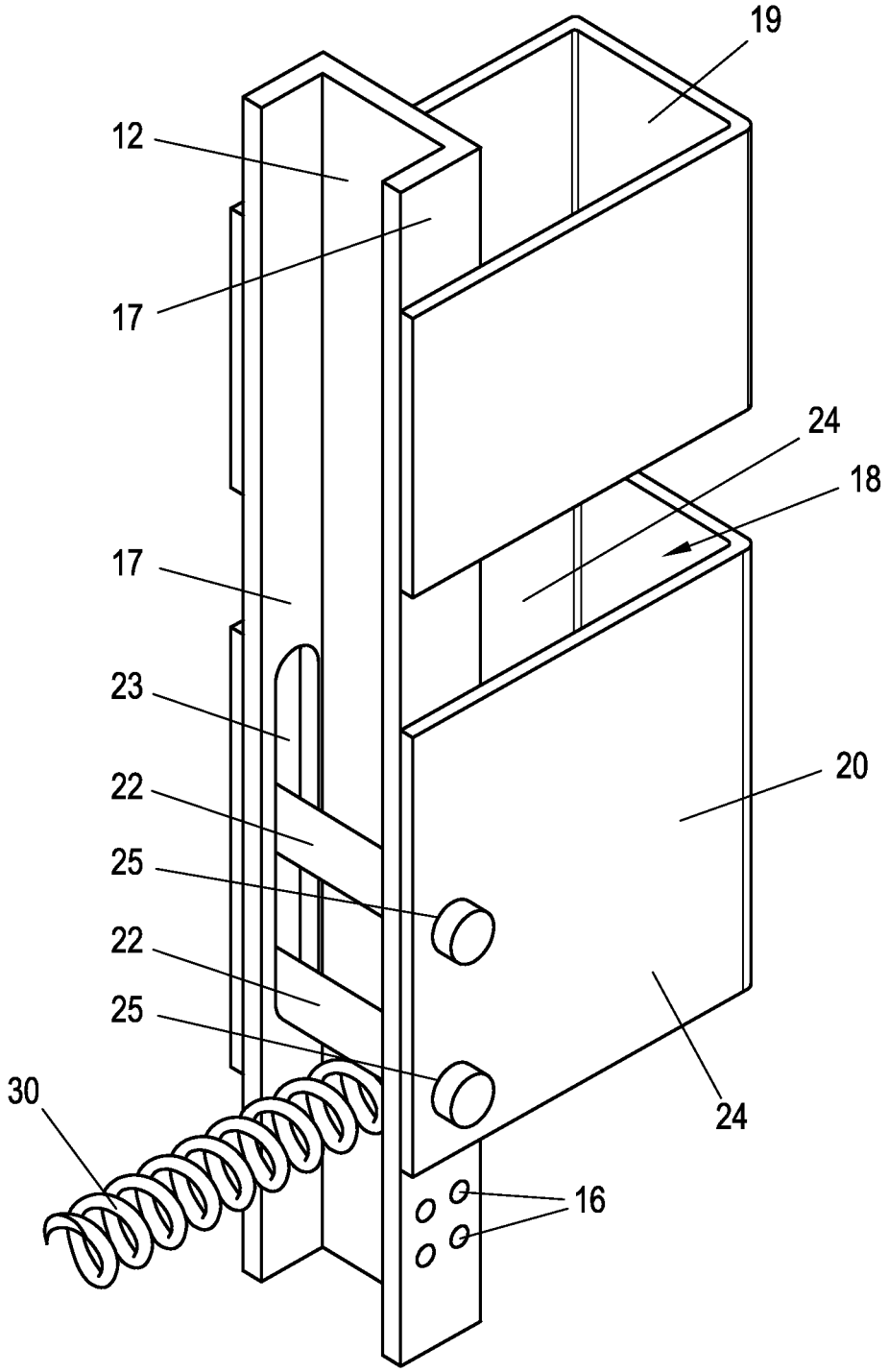
FIG. 4 shows the safety of FIG. 3 with the slide removed.

The firearm 1 according to the invention has a safety 10, illustrated in more detail in FIGS. 3 and 4, having a slide 11, which is mounted movably on a holder 12. For this purpose, the slide 11, which, in the embodiment which is illustrated and is preferred in the invention, consists of a U-shaped profile bent out of a metal sheet, has a pair of slots 14 in a lower region of each of the two legs 13, in which slots pins 15 are accommodated, which are inserted through holes 16 in legs 17 of the holder 12.

Mounted on the holder 12 or the legs 17 thereof there is furthermore a magazine well 18, which, in the embodiment illustrated, has a fixed section 19 mounted in a fixed manner on the holder 12 and a section 20 which is movable on the holder 12. The magazine well 18 or the sections 19 and 20 thereof, which are likewise illustrated only in a highly schematic way, likewise consist of a U-shaped profile bent out from a metal sheet in the preferred embodiment of the invention illustrated in the drawings.

The magazine well 18 has a longitudinal direction 21 and serves to accommodate a magazine 5 for the cartridges 6 of the firearm 1, wherein the magazine 5 is not illustrated in the drawings because it can likewise be embodied like magazines 5 known per se from the prior art. The magazine 5 can be inserted into the magazine well from below in FIG. 1, in the direction of the longitudinal direction 21 of the magazine well 18, and fixed in a manner known per se on the movable section 20. In the illustrated embodiment of the invention, a straight stick magazine is used, and therefore the longitudinal direction 21 is straight. In the case of a curved magazine, the longitudinal direction would likewise be correspondingly curved.

As FIGS. 2 and 3 show, the movable section 20 is movably mounted by means of two bolts 22 in slotted holes 23, which are formed in the legs 17 of the holder 12 and are aligned in the direction of or parallel to the longitudinal direction 21. The bolts 22 are secured in holes 25 in the legs 24 of the U-shaped profile of the movable section 20. In this way, the movable section 20 with the magazine 5 secured thereon can be moved on the holder 12 in the direction of the longitudinal direction 21 of the magazine well 18.

In the embodiment in FIGS. 3 and 4, both bolts 22 project laterally beyond the legs 24 of the movable section 20 of the magazine well 18 and form drivers for the movable section 20, as will be described below. In the embodiment in FIGS. 1 and 2, only one of the two bolts 22 projects laterally beyond the legs 24 of the movable section 20 of the magazine well 18 and forms a driver for the movable section 20.

The slide 11 furthermore has guides 26 in its legs 13. In the embodiment in FIGS. 1 and 2, only one guide 26 is formed in each leg 13 of the slide 11, whereas the guides 26 in the embodiment in FIGS. 3 and 4 are provided in pairs in order to prevent tilting or jamming of the slide 11 or of the movable section 20 of the magazine well 18 when the slide 11 and the movable section 20 are moved by actuation of the slide 11, as will be described below.

The guides 26 have a first, central region 27, a further region 28 and a third region 29, wherein regions 28 and 29 each adjoin one end of the central region 27. The central region 27 slopes by an angle $\alpha$ to the longitudinal direction 21 of the magazine well, and the regions 28 and 29 adjoining said central region are aligned substantially at a right angle to the longitudinal direction 21. The angle $\alpha$ is preferably of the order of 45° or above, although there has to be matching between the possible travel of the slide 11 and the necessary travel of the magazine 5 and can therefore vary from case to case.

The bolts 22 projecting beyond the legs 24 of the movable section 20 of the magazine well 18 engage in the guides 26. When the slide 11 is in the position illustrated in FIG. 1, which is referred to as the safety position, the movable section 20 of the magazine well 18 is in a lower position, in which a magazine 5 fixed on the movable driver 20 is arranged in a position in which it is so far from the bolt assembly 4 situated thereabove that an opening 7 of the magazine 5 which faces the bolt assembly 4 is outside the region of a driver for cartridges 6, which is arranged on the bolt assembly 4, in other words the driver cannot push a cartridge 6 out of the magazine 5 into the chamber 3 of the barrel 2.

Movement of the movable section 20 is not possible in this position of the slide 11 because the bolts 22 cannot be moved in the direction of the longitudinal direction 21 in the regions 28 aligned normally with respect to the longitudinal direction 21 since the slide 11 is prevented from moving in the direction of the longitudinal direction 21 by the pins 15 in the slots 14.

If the slide 11 is pushed manually to the right in FIG. 1, against the force of a compression spring 30 clamped between the slide 11 and the holder 12, the bolts 22 slide upward in the central regions 27 aligned obliquely to the longitudinal direction 21, as a result of which the movable section 20 of the magazine well 18 is likewise moved upward toward the fixed section 19. As a result, a magazine 5 fixed on the movable section 20 of the magazine well 18 is moved upward in the direction of the bolt assembly 4 as far as a feed position illustrated in FIG. 2, in which the bolt assembly 4 can engage the uppermost cartridge 6 in the magazine 5 and push it into the chamber 3 of the barrel 2.

When the slide 11 has been moved completely in the direction of the holder 12, the bolts 22 forming the drivers come into the region 28 of the guides 26, thereby reliably avoiding movement of the movable section 20 of the magazine well 18 out of the feed position just described into the safety position because the regions 28 are likewise aligned substantially transversely to the longitudinal direction 21.

If the slide 11 is released, it is pushed away from the holder 12 by the spring 30, as a result of which the movable section 20 of the magazine well 18 is moved back down into the safety position shown in FIG. 1 by means of the obliquely aligned central regions 27 of the guides 26 and the bolts 22 acting as drivers.

In addition or as an alternative, it is also possible, depending on the chosen design or dimensioning of the safety 10, for springs to engage on the movable section 20 and/or on the magazine 5, pushing the magazine 5 into the safety position.

It is self-evident that the embodiment of the guides 26 which is described in conjunction with the drawings, having the bolts or drivers 22, can also be modified. Thus, for example, it is not necessary for the bolts 22 used to guide the movable section 20 on the holder 12 simultaneously to be used also as drivers for engagement in the guides 26. It is also possible for separate projections arranged on the movable section 20 of the magazine well 18 to be provided as drivers.

It is likewise also possible for the guides to be arranged as drivers on the movable section 20 and the projections to be arranged on the slide 11. Finally, it is also possible not to embody the guides 26 in the form of slots or slotted holes which pass through the legs 13 of the slide 11 but to use grooves for this purpose, which by their very nature do not pass through the legs 13.

Finally, it is also possible, in an alternative embodiment of the invention, for the magazine well 18 not to consist of a fixed section 19 and a section 20 which is movable in the direction of the longitudinal direction 21 but for it to consist only of a fixed receptacle, as is known per se or conventional, wherein the projections or drivers which interact with the guide or guides 26 are then formed directly on the magazine 5. It is of course likewise also possible to arrange the guides as drivers directly on the magazine 5 and to arrange projections on the slide 11, which engage in the guides on the magazine 5.

If the safety 10 illustrated in the drawings is integrated into a firearm 1, e.g. a side arm, it can be integrated into the grip on which the trigger 8 of the weapon is situated, for example. In this case, the trigger 8 can be arranged directly above the slide 11, for example, thus enabling the slide 11 to be actuated with the fingers of the same hand with which the trigger 8 is also actuated. This makes it possible to ensure that the safety of the weapon is only released, by pushing the slide 11 fully in, when the shooter is holding the weapon correctly and firmly in their hand.

LIST OF REFERENCE SIGNS

1 firearm
2 barrel
3 chamber
4 bolt assembly
5 magazine
6 cartridge
7 opening
8 trigger
9 --
10 safety
11 slide
12 holder
13 leg
14 slot
15 pins
16 holes
17 leg
18 magazine well
19 fixed section
20 movable section
21 longitudinal direction
22 bolt
23 slotted holes
24 leg
25 holes
26 guide
27 central region
28 further region
29 third region
30 compression spring

The invention claimed is:

1. A firearm, comprising:

a barrel;

a trigger;

a bolt assembly;

a magazine movably disposed along a longitudinal direction in a magazine well;

a driver connected to said magazine;

a manually actuable slide mounted for movement substantially transversely to the longitudinal direction and for engaging said driver and moving said driver with said magazine from a safety position into a feed position; and when said manually actuable slide is moved in a first direction said driver with said magazine is moved from a safety position into a feed position, and when said manually actuable slide is moved in a second direction, substantially opposite to said first direction, said driver with said magazine is moved back from the feed position into the safety position.

2. The firearm according to claim 1, wherein said driver is arranged directly on said magazine.

3. The firearm according to claim 1, wherein said magazine well has a movable section that is movable in the longitudinal direction and is connected to said magazine, and wherein said driver is arranged on said movable section.

4. The firearm according to claim 3, wherein said magazine well has a fixed section and said movable section is movable in the longitudinal direction.

5. The firearm according to 3, wherein said slide and said movable section of said magazine well are movably mounted on a holder.

6. The firearm according to claim 5, further comprising a grip, and wherein said holder is arranged in said grip of the firearm.

7. The firearm according to claim 1, further comprising a guide connecting said slide and said driver to one another, said guide having a part that is aligned obliquely to the longitudinal direction.

8. The firearm according to claim 7, wherein said guide has an elongate aperture formed in said slide, and wherein said driver engages in said guide, or said driver is formed with an elongate aperture in which a projection on said slide engages.

9. The firearm according to claim 8, wherein said guide further includes a region, adjoining one end of said elongate aperture, which is aligned substantially transversely to the longitudinal direction.

10. The firearm according to claim 9, wherein said guide further includes a region, adjoining an end of said elongate aperture opposite said one end, which is aligned substantially transversely to the longitudinal direction.

11. The firearm according to claim 1, further comprising a spring, and wherein at least one of said slide, said magazine, and/or a movable section of said magazine well are movable out of a safety position into a feed position against a force of said spring.

12. The firearm according to claim 1, further comprising a driver for cartridges disposed on said bolt assembly, and said magazine being formed with an opening facing said bolt assembly; and wherein said opening is situated in a region of said driver for cartridges in the feed position and outside said region in the safety position.

13. The firearm according to claim 1, wherein said slide is arranged in vicinity of said trigger of the firearm.

* * * * *